US008960103B2

(12) United States Patent
Tranter et al.

(10) Patent No.: US 8,960,103 B2
(45) Date of Patent: Feb. 24, 2015

(54) APPARATUS FOR CONCEALING A PRODUCT

(75) Inventors: Nathan Arthur Tranter, Shepparton (AU); Terrence Paul Brown, Shepparton (AU)

(73) Assignee: Hills Holdings Limited, Hindmarch (AU)

( * ) Notice: Subject to any disclaimer, the term of this patent is extended or adjusted under 35 U.S.C. 154(b) by 0 days.

(21) Appl. No.: 13/532,644

(22) Filed: Jun. 25, 2012

(65) Prior Publication Data

US 2013/0285519 A1 Oct. 31, 2013

Related U.S. Application Data

(63) Continuation of application No. 10/580,985, filed as application No. PCT/AU2004/001648 on Nov. 25, 2004, now abandoned.

(30) Foreign Application Priority Data

Nov. 25, 2003 (AU) ..... 2003906484
Sep. 1, 2004 (AU) ..... 2004905002

(51) Int. Cl.

| | |
|---|---|
| ***A47B 57/00*** | (2006.01) |
| ***A47B 81/06*** | (2006.01) |
| ***A47B 17/04*** | (2006.01) |
| ***A47F 3/00*** | (2006.01) |
| ***A47F 5/00*** | (2006.01) |
| ***A47B 96/00*** | (2006.01) |

(52) U.S. Cl.

CPC ..... *A47B 81/061* (2013.01); *A47B 17/04* (2013.01); *A47B 81/065* (2013.01); *A47F 3/002* (2013.01); *A47F 5/0087* (2013.01); *A47B 96/00* (2013.01)

USPC ..... 108/60

(58) Field of Classification Search

USPC ..... 108/60, 25, 26, 13, 6; 312/248, 327, 312/328, 300, 270.2

See application file for complete search history.

(56) References Cited

U.S. PATENT DOCUMENTS

| | | | | |
|---|---|---|---|---|
| 2,872,178 | A * | 2/1959 | Holland | 177/142 |
| 2,048,363 | A | 7/1963 | Vogel | |
| 4,002,382 | A | 1/1977 | Wolf et al. | |
| 4,261,122 | A | 4/1981 | LeVine | |
| 4,625,657 | A | 12/1986 | Little et al. | |
| 4,706,845 | A | 11/1987 | Schnurer et al. | |
| 4,941,718 | A | 7/1990 | Alexander et al. | |
| 1,894,185 | A | 1/1993 | Martin | |
| 5,181,771 | A | 1/1993 | Robak et al. | |
| 5,247,744 | A | 9/1993 | Ferris et al. | |
| 5,261,645 | A * | 11/1993 | Huffman | 254/267 |
| 5,499,793 | A | 3/1996 | Salansky | |

(Continued)

FOREIGN PATENT DOCUMENTS

| | | |
|---|---|---|
| AU | 2004292334 B2 | 6/2005 |
| DE | 3304142 | 8/1984 |

(Continued)

*Primary Examiner* — Matthew Ing

(74) *Attorney, Agent, or Firm* — Quine Intellectual Property Law Group, P.C.

(57) ABSTRACT

Apparatus (2) for housing a product comprising a frame (4) mounted on or in a surface; and a member (6) moveable within the frame (4) and for securing the product wherein the member (6) is moveable between a first position in which the product is concealed from view and a second position in which the product is in view and accessible by a user.

16 Claims, 4 Drawing Sheets

(56) References Cited

U.S. PATENT DOCUMENTS

| | | | | |
|---|---|---|---|---|
| 5,513,579 | A | 5/1996 | Allan | |
| 5,713,475 | A | 2/1998 | Wang | |
| D410,163 | S | 5/1999 | McNeil | |
| 5,927,837 | A | 7/1999 | Schmidt | |
| 5,954,410 | A | 9/1999 | Noellert | |
| 6,209,846 | B1 * | 4/2001 | Barlow | 361/679.22 |
| 6,416,027 | B1 | 7/2002 | Hart | |
| 6,502,718 | B2 | 1/2003 | Fitzgerald et al. | |
| 2002/0073632 | A1 | 6/2002 | Huffman | |
| 2002/0079792 | A1 | 6/2002 | Nott et al. | |
| 2004/0206712 | A1 | 10/2004 | Wicha et al. | |
| 2007/0091286 | A1 * | 4/2007 | Davis et al. | 353/122 |

FOREIGN PATENT DOCUMENTS

| | | |
|---|---|---|
| GB | 2393975 | 4/2004 |
| NZ | 508084 | 6/2001 |

* cited by examiner

APPARATUS FOR CONCEALING A PRODUCT

CROSS REFERENCE TO RELATED APPLICATIONS

This Application is a Continuation of Ser. No. 10/580,985, filed Oct. 5, 2006 and now abandoned, which is a 371 of PCT/AU2004/001648, filed Nov. 25, 2004. Foreign priority is claimed to AU 2004905002, filed Sep. 1, 2004 and AU 2003906484, filed Nov. 25, 2003.

FIELD OF THE INVENTION

This invention relates to apparatus for housing a product, such that when the product is not in use, it is concealed from view.

BACKGROUND OF THE INVENTION

In many installations of products, such as data/video projectors, monitors, telephones or keyboards it is paramount that protection is afforded to the product against theft or damage. It is often not feasible to remove these products from their locations when not in use either due to the size of the product or connection of leads to the product. Previous solutions to this problem have included the use of a motorized lift which retracts the product into a surface, such as a ceiling. Some problems associated with these devices are that often when the product is in use the opening in the ceiling is not sealed off, giving unsightly views and loss of effectiveness of heating and/or cooling systems. These types of lifts are also quite cumbersome requiring a large surface cavity in which to be housed and a difficult installation process. Another benefit of this type of discrete installation is the aesthetics, in many applications it is not desirable to view the projection unit when not in use.

The present invention seeks to provide an apparatus for housing a product which is concealed from view when not in use. In this manner, after a product has been used, it can be stowed away from view and its surrounds are aesthetically more appealing when the product is unnoticeable.

SUMMARY OF THE INVENTION

According to a first aspect of the invention there is provided apparatus for housing a product comprising:

a frame mounted on or in a surface; and a member moveable within the frame and for securing the product; wherein the member is moveable between a first position in which the product is concealed from view and a second position in which the product is in view and accessible by a user.

According to an embodiment, the member may substantially cover an opening through the frame in the first position or the second position. The apparatus may further comprise pivot means, such as pins, axles or rods, connecting the frame to the member to enable movement of the member between the first position and the second position. The member may comprise a panel that fits within the frame and is rotatable within the frame through the pivot means. An elongate bar may be attached adjacent opposite sides of a four sided panel and in which is formed a portion of the pivot means. The pivot means may comprise a rod attached to or formed in each of the bars and a bush formed in corresponding sides of a four sided frame for receiving a respective rod. The panel preferably is level with the frame in each of the first and second positions.

The panel may rotate up to 360 degrees about the pivot means. In this manner, the apparatus retracts the product, such as a projection unit, into a surface, such as a ceiling by means of the revolving panel that fits within the frame and rotates 360° within this frame, pivoted in the center of either two parallel sides.

There may be one or more recesses in a side (section) of the frame to enable cables to be connected to the product without interfering with the movement of the product and the member.

According to a further embodiment, the member may include a first panel and a second panel connected by one or more side frames. The first panel may be level with the frame and closes the opening in the first position. The second panel may be level with the frame and closes the opening in the second position. A portion of the first panel may be connected to the frame through the pivot means. The first panel may have a pair of legs extending therefrom, a distal end of each leg being connected to the frame through the pivot means. The pivot means may comprise a rod attached or formed in each of the legs and a bush formed in corresponding sides of a four sided frame for receiving a respective rod. Each side frame may be shaped to enable the first panel to remain level with and in the frame in the first position and to enable the second panel to remain level with and in the frame in the second position. Each side frame may comprise four sections joined in the shape of a quadrilateral, with a section joined respectively to the first panel and the second panel.

In another form of the invention a motor can be connected to the pivot means in order to control the pivot means to operate the member to move between the first position and the second position. Thus, one of the axles/rods could be extended outside the frame in such a way that a motor may be attached to the axle allowing the panel or panels to be rotated by the motor. The motor may be remote controlled.

The product may be any one of a projector unit, keyboard, telephone or monitor and the surface may be any one of a ceiling, wall, floor, desktop or a part of a piece of furniture. Each panel may be made of craft wood or any other appropriate material that can be attached to the pivot means and allows for the ability to attach a product, such as a projection unit to the panel. The frame may be fabricated from metal or be constructed from moulded plastic.

BRIEF DESCRIPTION OF THE DRAWINGS

One or more preferred embodiments of the invention will hereinafter be described, by way of example only, with reference to the accompanying drawings in which.

DETAILED DESCRIPTION OF PREFERRED EMBODIMENTS

Figure 1:
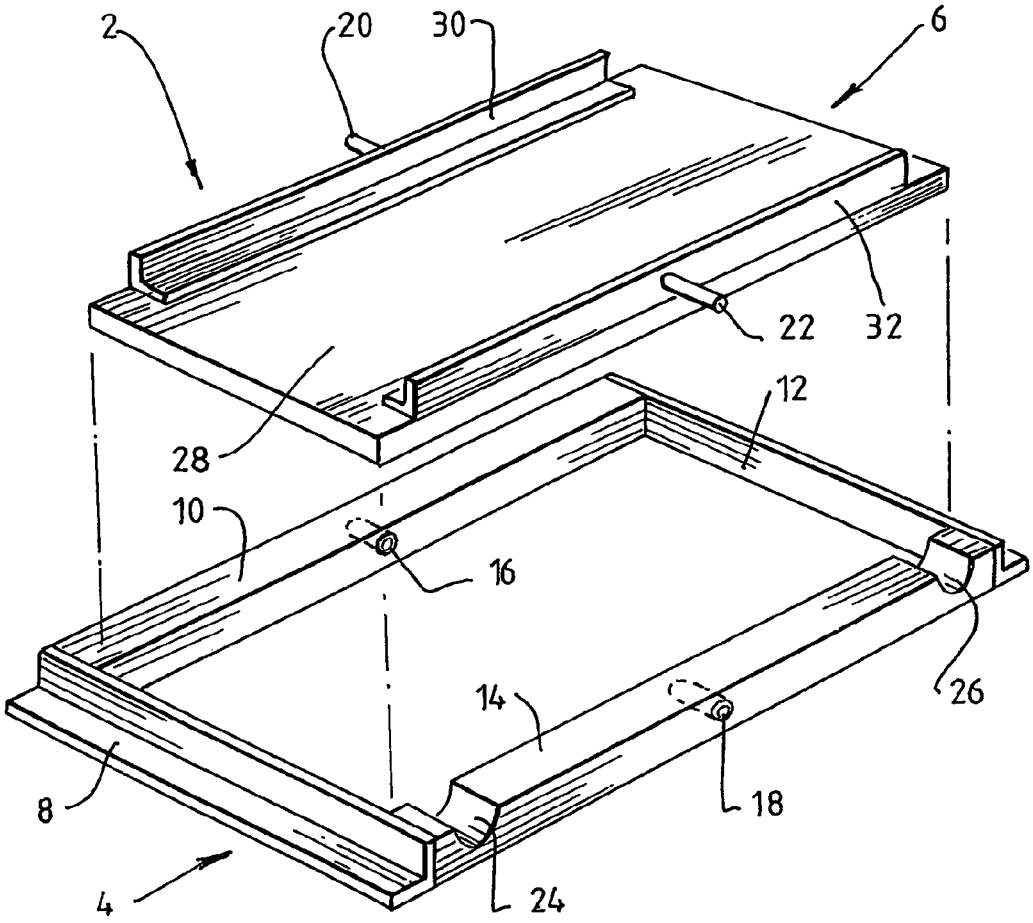
FIG. 1 is a perspective view showing a frame and member of apparatus for concealing a product according to a first embodiment.

With reference to FIG. 1 there is shown a first embodiment of apparatus that is used to conceal a product. The apparatus 2 includes a frame 4 and a member 6 which includes a panel freely rotatable within the frame 4. The frame 4 is constructed of four sections or sides 8, 10, 12 and 14 that are shown joined to each other approximately in the form of a square. The sections 8, 10, 12 and 14 may be made from metal, such as steel, or from moulded plastic and be joined to each other by welding or other known joining techniques. In this instance these sections are all approximately of the same length, but may vary in length or shape depending on the application or for which product is to be concealed when not in use. Located at approximately midway along the sections 10 and 14 are bushes 16 and 18 for receiving and supporting corresponding rods or axles 20 and 22 forming part of the member or panel 6. Located either end of the section 14 are recesses 24 and 26 to enable cables to be attached to the product so as not to get entangled when the apparatus 2 is rotated between a second position in which it is in use and a first position when it is concealed from view and not in use. The bushes 16, 18 may be suitably made of brass or nylon or any other low wearing material.

The member 6 comprises a panel 28 of a thickness and size so that it fits within the opening of the frame 4. The panel 28 can be made of a suitable material such as craft wood that is easily painted and can match the surrounding surface. Attached adjacent two opposite sides of the panel 28 are pivot bars 30 and 32 which are shorter in length than the adjacent side of the panel 28. Approximately at the center of the bars 30 and 32 are the axles 20 and 22 that fit within corresponding bushes 16 and 18 of frame 4 to support the member 6 within the frame 4 and allow free rotation of the member 6 within the frame 4. The axles 20 and 22 may suitably be made of metal and in particular brass or steel. The bars 30 and 32 may also be made of steel and for added rigidity and strength are in the form of an L section or right-angled bar.

Figure 2A:
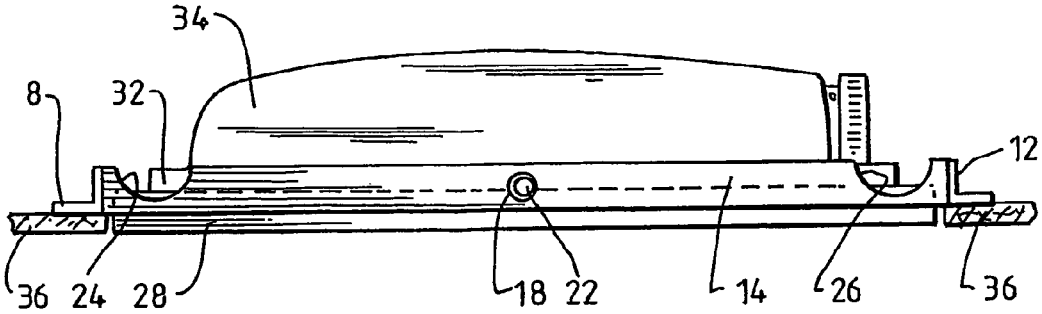
FIGS. 2(A), 2(B) and 2(C) respectively depict the apparatus of FIG. 1 in a first (closed) position, the member in a rotating position and the apparatus in a second (open) position.
Figure 2B:
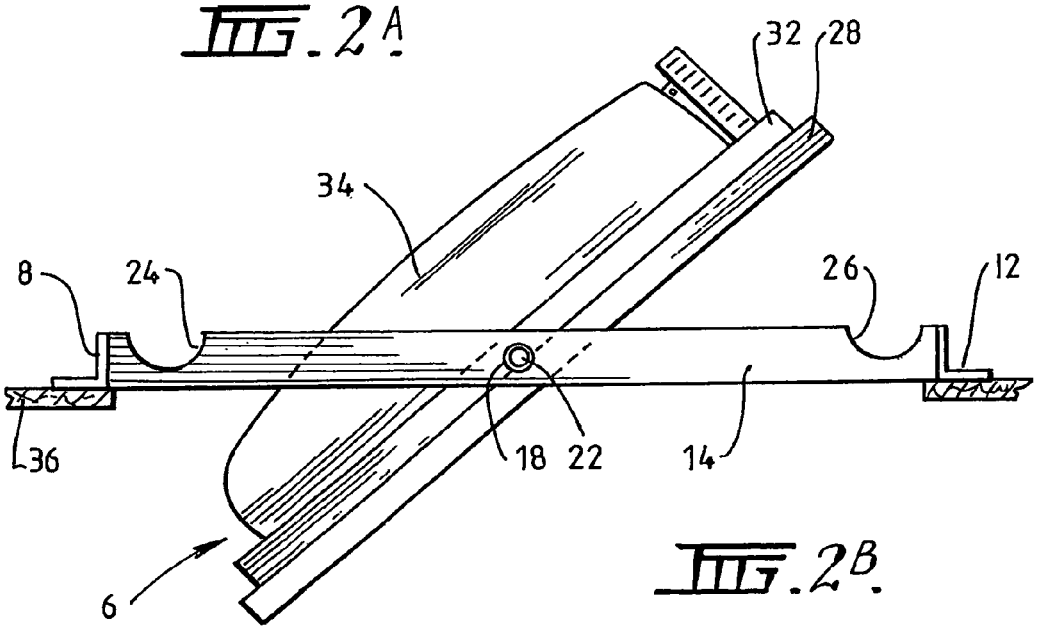
Figure 2C:
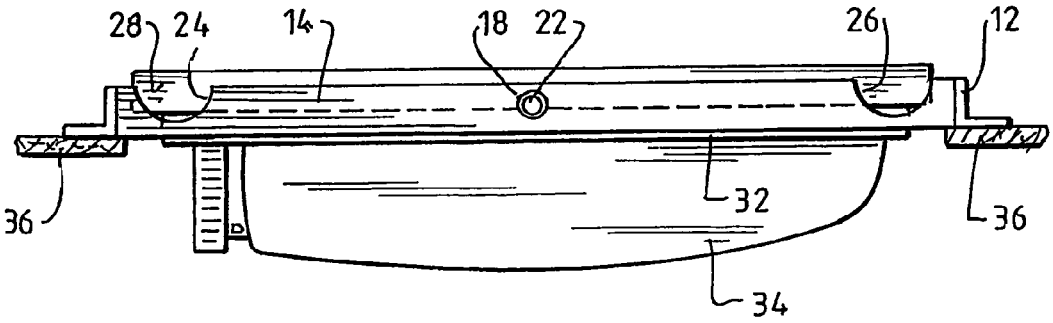

With reference to FIGS. 2A, 2B and 2C there is shown three views showing the operation of the apparatus with a product, in the form of a projector unit, attached to member 6. In FIG. 2A the projector unit 34 is concealed from view and is not in use. The frame 4 together with the member 6 are fitted to a surface 36, in this particular instance a ceiling. Alternatively the product may be a keyboard, monitor or telephone that is fitted to the apparatus 2 and installed in a cavity mounted in another surface, such as a desk, piece of furniture, wall or floor. In FIG. 2A the sections 8 and 12 are directly mounted to the internal portion of ceiling 36 to provide a support for the apparatus 2. The projector unit 34 is shown in a first position where it is concealed from view and securely attached or fitted to panel 28 of member 6. In FIG. 2B the member 6 is rotated, pivoting on rods 20 to 22 towards a second position as shown in FIG. 2C where it is ready for use. Thus the projector unit 34 is able to be rotated 180° from its position shown in FIG. 2A to its position shown in FIG. 2C. It maybe further rotated another 180° so that a full 360° rotation is possible. In FIG. 2C the projector unit 34 may be secured or locked in position (not shown).

Figure 3:
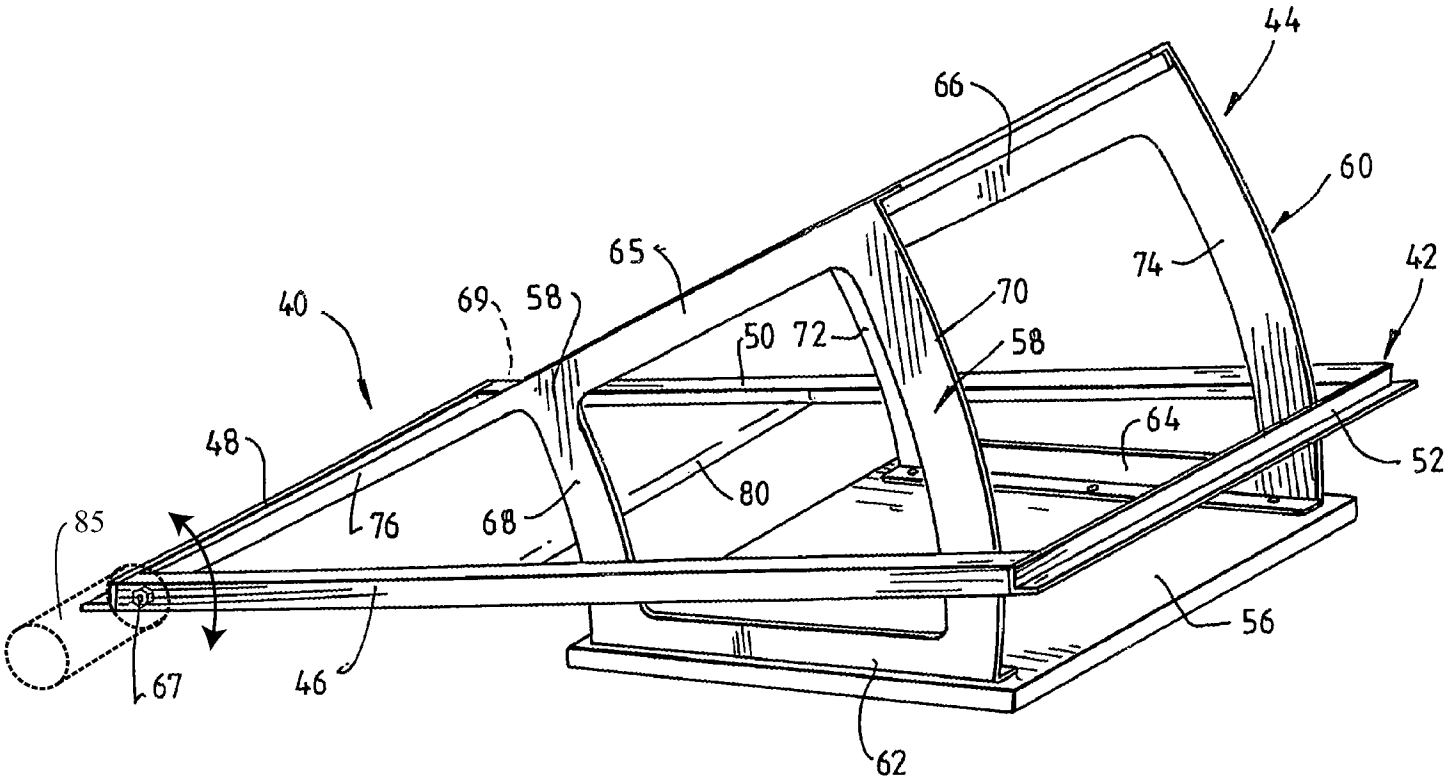
FIG. 3 is a perspective view of apparatus for concealing a product according to a second embodiment shown in a slightly open position.

With reference to FIG. 3 there is shown a further embodiment of an apparatus 40 used to conceal a product. The apparatus 40 comprises a frame 42 and a member 44 which freely rotates within the frame 42. The frame 42 comprises four sections/sides 46, 48, 50 and 52 which are preferably made from metal, such as steel or brass and are joined to each other to form substantially a rectangular shape. Such joining may be done by welding or any other suitable joining means. The frame 42 is adapted to fit within a cavity protruding through a surface, such as a ceiling.

The member 44 comprises a pair of panels 54 and 56 with panel 54 adapted to fit flush within the frame 42 when the member 44 is in an open position, such that a product housed between the panels 54 and 56, is operable and in use. Panel 56 is adapted to fit flush within the frame 42 when the product is not in use and is therefore concealed by the panel 56. Suitably the panel 56 and the panel 54 are adapted to match the surrounding ceiling characteristics or surface characteristics. The panels 54 and 56 may be made from a suitable timber that can be painted to match the surrounding surface characteristics. Both panels 54 and 56 are joined together by side frames 58 and 60 each of which comprises four sections or members defining an opening. Member 62 of side frame 58 and member 64 of side frame 60 are suitably secured to a top face of panel 56. Member 65 of side frame 58 and member 66 of side frame 60 are suitably secured to a lower face of panel 54. Members 68 and 70 of side frame 58 and members 72 and 74 of side frame 66 provide necessary support between the respective panels 54 and 56.

A pair of legs 76 and 78 extend from members 65 and 66 and are connected at their distal ends to frame 42 by a pair of rods 67 and 69 which are housed in respective bushes formed in members 46 and 50 of frame 42. The rods 67 and 69 are secured respectively to the legs 76 and 78 so that the member 44 is able to freely rotate within the frame 42 via the hinge motion or action provided by the rods connecting the legs 76 and 78 to the frame 42.

In situations where the panels 54 and 56 are shorter in length than the entire frame 42 a further ceiling panel 80 may be incorporated within the frame 42.

Figure 4:
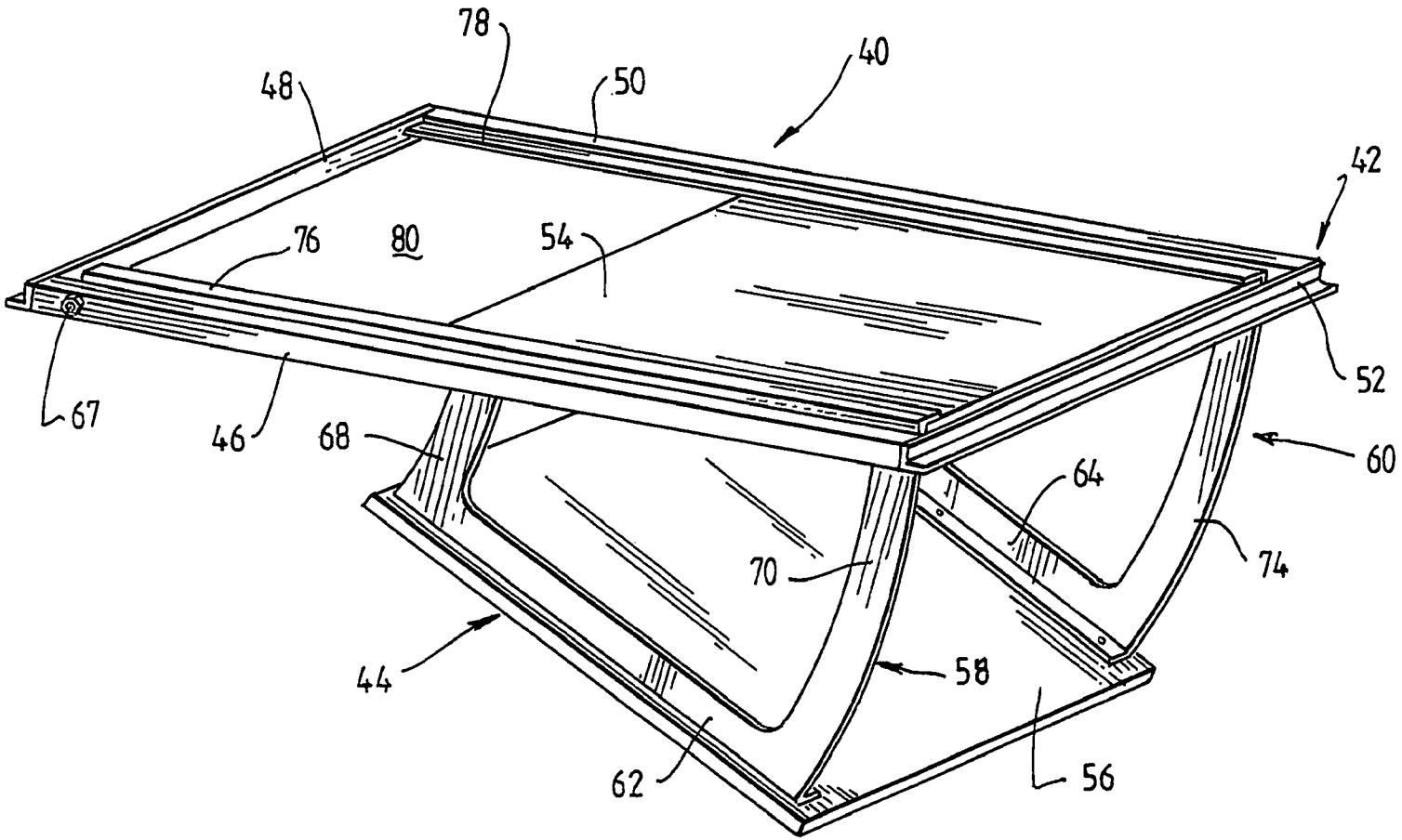
FIG. 4 is a perspective view of the apparatus of FIG. 3 shown in a fully open or second position.

Thus in FIG. 3 the apparatus 40 is shown partially open where the panel 56 is below the level of frame 42. Where it is in a first closed position such that the product mounted between the panels 54 and 56, such as a projector unit, is concealed the panel 56 is level and fits within the frame 42 between ceiling portion 80 and members 46, 50 and 52 of frame 42. It can be secured or suitably locked in position. With reference to FIG. 4 the apparatus 40 is shown in a fully open position whereby the product that is housed between the panels 54 and 56 is able to be used or operated. In this situation the panel 54 is flush within the frame level with members 46 and 50 and extra panel 80. Thus to the user the panels 54 and 80 are level with the surrounding ceiling so that aesthetically there is no gap provided in the ceiling. Again the position of the apparatus shown in FIG. 4 can be locked in place by suitable locking means. Each of the bushes, rods and side frames may be made from a suitable material such as steel, brass, plastics or nylon. Each of the sections 48 and 52 may be suitably made in an L shaped configuration having a ledge which can provide suitable connection to the inner portion of the ceiling or surface that the apparatus is attached to.

Where additional ceiling panel 80 is not required then the panels 54 and 56 will extend along the entire area within the frame so that either in the open position or the closed position the respective panel matches the surrounding surface and therefore provides no gap or a cavity, in which the apparatus is installed, is not visible to users. Additionally the side frames 58 and 60 have respective legs or portions 68, 70, 72 and 74 which are so shaped that enable panel 54 to remain substantially level within frame 42 in the open position and allows panel 56 to be substantially level within frame 42 in the closed position.

With regard to both embodiments described a motor may be connected to the apparatus in order to rotate the respective members 6 or 44 between open and closed positions. With regard to the first embodiment a motor may be attached to either one or both of rods or pins 20 and 22. In the second embodiment of FIG. 3 a motor may be attached accordingly to the rods 67 and 69 connected to legs 76 and 78 so that rotation of the rods or pins rotate the frame 44 between open and closed positions. The motor may include an electronic circuit that has an infrared receiver so that infrared signals may be sent from a remote control unit to control a motor to operate the apparatus. Hence, rotation of the members 6 or 44 can be initiated and stopped when the product is in the desired position.

As mentioned previously the apparatus is not only useful for a ceiling mounting of projector units and the like but can also be used to conceal products in a wall, a floor, a piece of furniture or another suitable location such as a desk top. The invention is not limited to concealing projector units and the like but also may be used to conceal other products such as visual display units, keyboards, telephones and any other particular product that requires concealment when not in use.

The invention claimed is:

1. A mounting apparatus for a projector, the apparatus comprising:

a frame having an opening for mounting in a cavity in a surface;

a member moveable within the frame and upon which the projector unit is secured such that the projector remains secured during movement of the member and throughout operation of the projector; and a pivot assembly connecting the member to the frame, thereby enabling movement of the member between a first position and a second position wherein the pivot assembly is located adjacent an opening to said cavity;

such that in the first position the projector is concealed from view while secured to said member, and in the second position the projector is in view and the moveable member and projector are at or near the surface and the projector is aimed for immediate personal operation by a user, wherein the projector remains secured to the member throughout operation by the user and without requiring the projector unit to be physically removed from the apparatus, wherein an elongate bar is attached adjacent opposite sides of a four sided panel and in which is formed a portion of the pivot assembly.

2. The apparatus according to claim 1, wherein the member substantially covers the opening through the frame in the first position.

3. The apparatus according to claim 1, wherein the member substantially covers the opening through the frame in the second position.

4. The apparatus according to claim 1, wherein the pivot assembly comprises a rod attached to or formed in each of the bars and a bush formed in corresponding sides of a four sided frame for receiving a respective rod.

5. The apparatus according to claim 4, wherein the panel resides level with the frame in each of the first and second positions.

6. The apparatus according to claim 1, wherein a motor is connected to the pivot means in order to control the pivot assembly to operate the member to move between the first position and the second position.

7. The apparatus according to claim 6, wherein the motor is remote controlled.

8. The apparatus according to claim 1, wherein the surface is any one of a ceiling, wall, floor, desktop or a part of a piece of furniture.

9. A mounting apparatus for a projector, the apparatus comprising: a frame having an opening for mounting in a cavity in a surface; a member moveable within the frame and upon which the projector unit is secured such that the projector remains secured during movement of the member and throughout operation of the projector; and a pivot assembly connecting the member to the frame, thereby enabling movement of the member between a first position and a second position wherein the pivot assembly is located adjacent an opening to said cavity; such that in the first position the projector is concealed from view while secured to said member, and in the second position the projector is in view and the moveable member and projector are at or near the surface and the projector is aimed for immediate personal operation by a user, wherein the projector remains secured to the member throughout operation by the user and without requiring the projector unit to be physically removed from the apparatus, wherein the member includes a first panel and a second panel connected by one or more side frames.

10. The apparatus according to claim 9, wherein the first panel is level with the frame and closes the opening in the first position.

11. The apparatus according to claim 9, wherein the second panel is level with the frame and closes the opening in the second position.

12. The apparatus according to claim 11, wherein a portion of the first panel is connected to the frame through the pivot assembly.

13. The apparatus according to claim 12, wherein the first panel has a pair of legs extending therefrom, a distal end of each leg being connected to the frame through the pivot assembly.

14. The apparatus according to claim 13, wherein the pivot assembly comprises a rod attached or formed in each of the legs and a bush formed in corresponding sides of a four sided frame for receiving a respective rod.

15. The apparatus according to claim 14, wherein each side frame is shaped to enable the first panel to remain level with and in the frame in the first position and to enable the second panel to remain level with and in the frame in the second position.

16. The apparatus according to claim 15, wherein each side frame comprises four sections joined in the shape of a quadrilateral, with a section joined respectively to the first panel and the second panel.

* * * * *